US005333937A

United States Patent [19]

Hopkins

[11] Patent Number: 5,333,937

[45] Date of Patent: Aug. 2, 1994

[54] EXCAVATION MACHINE HAVING COMBINED IMPACT HAMMERS AND STATIC RIPPER PICK

[76] Inventor: David J. Hopkins, 5617 236th Ave. NE., Redmond, Wash. 98053

[21] Appl. No.: 962,493

[22] Filed: Oct. 14, 1992

[51] Int. Cl.[5] ..... E21C 25/02; E21C 27/28

[52] U.S. Cl. ..... 299/70; 173/4; 173/192

[58] Field of Search ..... 299/37, 69, 70, 94; 173/4, 31, 32, 34, 37, 192

[56] References Cited

U.S. PATENT DOCUMENTS

| | | | |
|---|---|---|---|
| 1,465,372 | 8/1923 | Starr et al. | 299/70 |
| 1,677,430 | 7/1928 | Collins | 173/192 X |
| 1,884,946 | 10/1932 | Wineman | 299/10 |
| 2,614,822 | 10/1952 | Miller | 299/69 |
| 2,750,178 | 6/1956 | McCallum | 299/76 X |
| 2,792,205 | 5/1957 | Hagenbook | 299/76 X |
| 2,801,092 | 7/1957 | Joy | 299/55 |
| 2,801,093 | 7/1957 | Joy | 299/10 |
| 3,032,325 | 5/1962 | Peterson | 299/67 |
| 4,025,116 | 5/1977 | Roepke et al. | 299/17 |
| 4,098,538 | 7/1978 | Hilton | 299/33 |
| 4,106,815 | 8/1978 | Dunn | 299/59 |
| 4,453,773 | 6/1984 | Toffolon | 299/37 |
| 4,682,819 | 7/1987 | Masse | 299/10 |
| 4,746,170 | 5/1988 | Etherington et al. | 299/75 |
| 4,796,956 | 1/1989 | Fadeev et al. | 299/69 |

FOREIGN PATENT DOCUMENTS

| | | | |
|---|---|---|---|
| 2920419 | 11/1990 | Fed. Rep. of Germany | 299/70 |

*Primary Examiner*—David J. Bagnell
*Attorney, Agent, or Firm*—Hughes, Multer & Schacht

[57] ABSTRACT

An excavating machine having a cutter head which is provided with both reciprocating impact hammers and a static pick. The impact hammers are mounted on either side of the static pick so as to flank this, and the tip of this can be extended or retracted relative to the tips of the hammers. The ripper pick can thus scarf out a mound of earth left between the two impact hammers, or can be extended to cut a channel into which the impact hammers then drive the adjacent material. The impact hammers can be tilted relative to the axis of the ripper pick so that their tips either precede or follow that of the pick as they are moved across the working face. The cutter assembly may be mounted to a tracked vehicle so as to extend forwardly from this for continuous mining, or laterally from this for long wall mining.

11 Claims, 10 Drawing Sheets

EXCAVATION MACHINE HAVING COMBINED IMPACT HAMMERS AND STATIC RIPPER PICK

FIELD OF THE INVENTION

The present invention relates to excavation equipment, and in particular, but not exclusively, to machinery for mining through rock and soil.

BACKGROUND OF THE INVENTION

Machines for tunnelling through the earth on a continuous basis are known, and examples of these include continuous mining machines which are used to mine coal. Typically, these machines employ a rotating cylindrical cutting head which cuts into the coal so that this falls away in chunks or blocks, and these are then transported out of the tunnel by a conveyor belt or other means.

Machines of this type have proven highly successful for mining coal, which is a relatively soft and non-abrasive material, but they are generally incapable of tunnelling through rock or most types of soil. In addition to rock, examples of such soils include ordinary earth, as well as relatively more solid material such as cemented conglomerate and permafrost. For purposes of illustration, the following description will discuss application of the mining machine of the present invention to excavation of permafrost; however, it will be understood that the present invention is not limited to this particular application, and that the structure discussed below and its operation and advantages apply with equal force to the excavation of other earth and materials, or even the demolition of buildings or other structures.

Permafrost soils occur widely in the polar regions of the world. The composition of the permafrost soil itself varies somewhat, but commonly this is a frozen alluvial deposit consisting of gravel or cobbles suspended in a matrix of clay and ice, with occasional large boulders being interspersed in this. Various operations undertaken in arctic regions require tunnelling through this material, including both mineral mining and petroleum production, and conventional continuous mining machines have proven wholly unsuitable for this. In large part, this is due to the compressive strength and extreme abrasiveness of the materials (e.g., the quartz gravel and frozen clay) which make up the permafrost soil, and furthermore the large boulders which are frequently encountered in the permafrost are utterly beyond the capabilities of such machines.

In addition to the continuous mining machines described above, machines referred to as "roadheaders" are also known to those skilled in the tunnelling art, these typically being used to remove rock faults and other areas of hard material which are encountered in coal mining. Typically, these machines include a chassis on which a turntable is mounted for rotation in the horizontal plane, this being achieved by means of hydraulic slew rams which are connected between the turntable and the chassis. The turntable assembly supports a boom which is mounted for pivotal movement in a vertical plane, and this carries a rotating conical head having a scroll formation of "picks" arranged on it. An example of a roadheader of this type is the Mk2B series machine, available from the Dosco Corporation, Route 10, Box 324, Abingdon, Va., U.S.A.

While machines of this type are quite capable of removing many obstacles formed of rock or other very hard material, they are not suited to continuous excavation of a tunnel at a relatively high rate of speed. Furthermore, they are not suitable for excavation of soil materials such as the permafrost material described above. For example, the rotating head assembly is susceptible to excessive wear in the highly abrasive environment which is posed by permafrost and similar soils, and the head also tends to reduce or "chew" such material into unnecessarily small particles, which represents excessive energy consumption. Perhaps more fundamentally, the high-speed rotating cutter head of these machines is only effective against a competent face, and will tend to bounce off of boulders when these become dislodged from the soil, rather than breaking them up; furthermore, should the rotating cutter head encounter a firmly lodged boulder while working through the surrounding matrix, the impact may actually tear the picks off of the head and destroy it.

Accordingly, a need exists for a machine to excavate tunnels through rock and soils at a relatively high rate of speed, which machine will obviate the numerous disadvantages which are exhibited by known types of continuous mining machines with respect to such applications.

SUMMARY OF THE INVENTION

The present invention has solved the problems cited above, and is a mining machine which comprises broadly a chassis, a cutter assembly mounted to the chassis assembly and comprising (a) at least one reciprocating hammer having a tip portion and (b) at least one static pick having a tip portion, and means for moving the tip portions of the reciprocating hammer and the static pick in combination across the working face so as to remove material therefrom. The at least one reciprocating hammer may comprise first and second impact hammers which are mounted generally on opposite sides of the static pick so that the tip portions thereof generally flank the tip portion of the pick.

Preferably, the machine may further comprise means for selectively (a) extending the tip portion of the static pick forwardly of the tip portions of the impact hammers towards the working face, and (b) retracting the tip portion of the pick rearwardly of the tip portions of the hammers away from the working face.

The means for moving the tip portions of the hammers and pick in combination may comprise means for moving these together simultaneously along a path across the working face. Means may also be provided for selectively offsetting the tip portions of the impact hammers from the tip portion of the static pick so that the tip portion of the pick advances or trails the tip portions of the hammer as these move together along such a path. This means for offsetting the tip portions may comprise means for pivoting the impact hammers relative to a longitudinal axis of the static pick.

In a preferred embodiment, the means for moving the tip portions of the hammers and pick in combination may comprise a turntable which is mounted to the chassis assembly of the machine for rotation in a generally horizontal plane, and a carriage assembly which is pivotably mounted to the turntable for elevation in a generally vertical plane, with the cutter assembly being mounted to this carriage assembly. The carriage assembly itself may comprise a support portion to which the static pick is fixedly mounted, and an articulated portion to which the impact hammer is mounted. This articulated portion is selectively pivotable relative to the support portion so as to pivot the tip portion of the impact hammers through planes generally parallel to the longitudinal axis of the static pick, to positions in which the tip portions of the hammers are offset from the tip portion of the pick, so that the tip portion of the pick advances or trails the tips of the hammers as the carriage is elevated in the vertical plane.

In such preferred embodiment, the carriage assembly may further comprise means for selectively (a) extending the tip portion of the static pick forwardly of the tips of the impact hammers, and (b) retracting the tip of the static pick rearwardly of the tips of the hammers. This means for selectively extending and retracting the tip portion of the static pick may comprise a telescoping portion of the pick, and an extendable ram mounted to the pick for selectively extending and retracting this telescoping portion. The carriage assembly may also comprise means for selectively extending the tip portions of the impact hammers and static pick together forwardly from the chassis assembly; this means may comprise at least one extendable ram operatively interconnecting the carriage and the chassis assembly for selectively extending the support and articulated portions of the carriage forwardly from the chassis assembly.

These and other novel features and advantages of the present invention will become apparent from the following detailed description, wherein reference is made to the Figures in the accompanying drawing.

DETAILED DESCRIPTION

I. TUNNELLING EMBODIMENT

Overview

Figure 1:
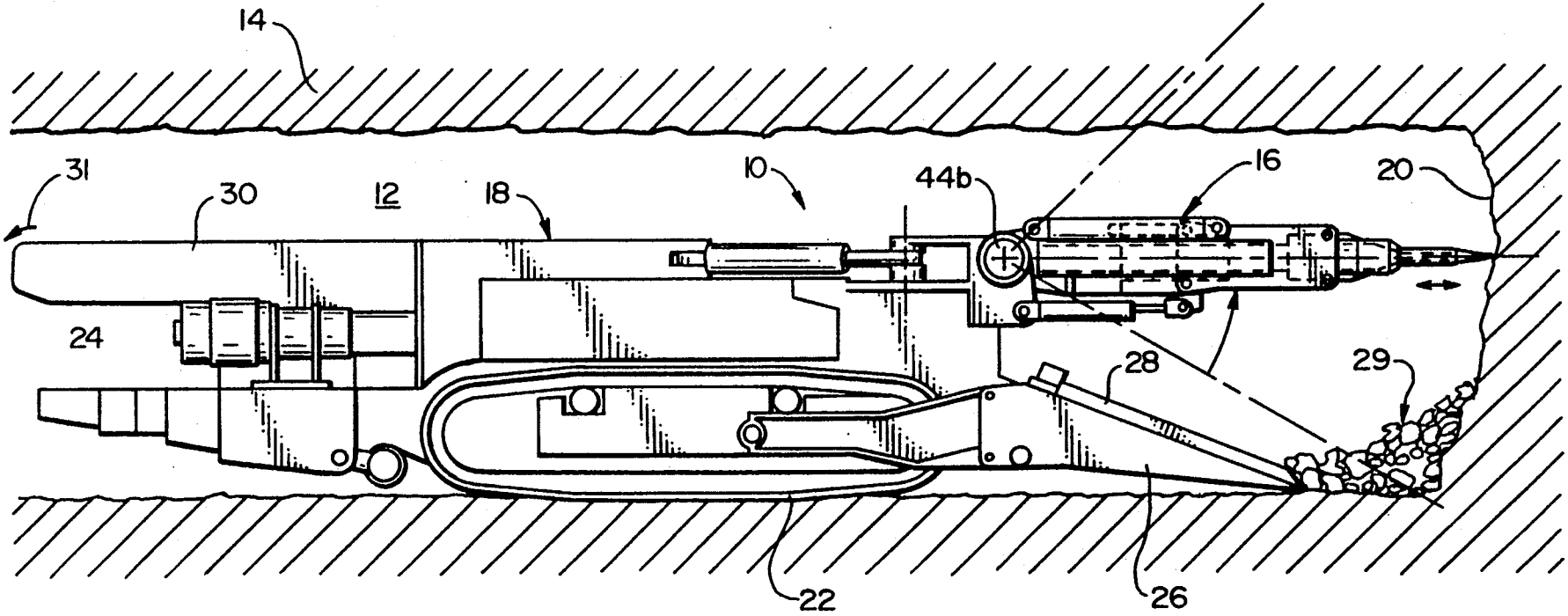
FIG. 1 is a side elevational view of a continuous mining machine which incorporates the present invention, this showing the machine in the process of excavating a tunnel, and the manner in which the cutting assembly is elevated through a vertical arc to do this.

FIG. 1 shows a machine 10 which incorporates the present invention, this being employed to excavate a tunnel 12 through earth formation 14. The machine is made up of two major components, namely a cutter assembly 16 and a carrier assembly 18. The cutter assembly is pivotably mounted to the carrier assembly so as to be rotatable in vertical and horizontal arcs, and this incorporates a pair of impact hammers which flank a static pick. As the cutter assembly operates, the impact hammers and pick dislodge material from the working face 20 of the tunnel, so that this falls away to the tunnel floor.

The carrier assembly 18 provides the transport unit for the cutter assembly, and also removes the dislodged material as the machine progresses. This is provided by a conventional roadheader chassis, from which the rotating cutter assembly has been removed, a suitable chassis being that of a Model SL120 roadheader available from the Dosco Corporation. Since the carrier assembly 18 is therefore a conventional "off-the-shelf" piece of equipment which is already well known to those skilled in the art, it will be described here only in general terms so as to provide the reader with a better understanding of how this relates to the operation of the present invention.

Carrier assembly 18 is essentially a tracked vehicle riding on caterpillar treads 22. At its rearward end there is an air-cooled electric motor 24, and this drives the hydraulic pump which provides hydraulic pressure to the various operating systems of the machine, including those of the cutter assembly. At the forward end there is a gathering apron 26 which is of conventional design, this having an angled upper surface which is swept by rotating spinner discs 28; these pick up the fallen debris 29 at the base of the working face, and sweep this across the face of the apron into the mouth (not shown) of a conveyor system which passes through the middle of the machine. At the rear of the machine, the conveyor belt 30 discharges the material in the direction indicated generally by arrow 31, into awaiting hoppers (not shown) or onto a second conveyor belt for carrying the materials out of the tunnel.

The carrier assembly 18 is provided with a station for an operator, from which he is able to observe the progress of the work. As the hammers and pick of the cutter assembly remove materials from the working face 20, the operator drives the machine forward on treads 22 so that the mining progresses on a continuous basis.

Figure 2:
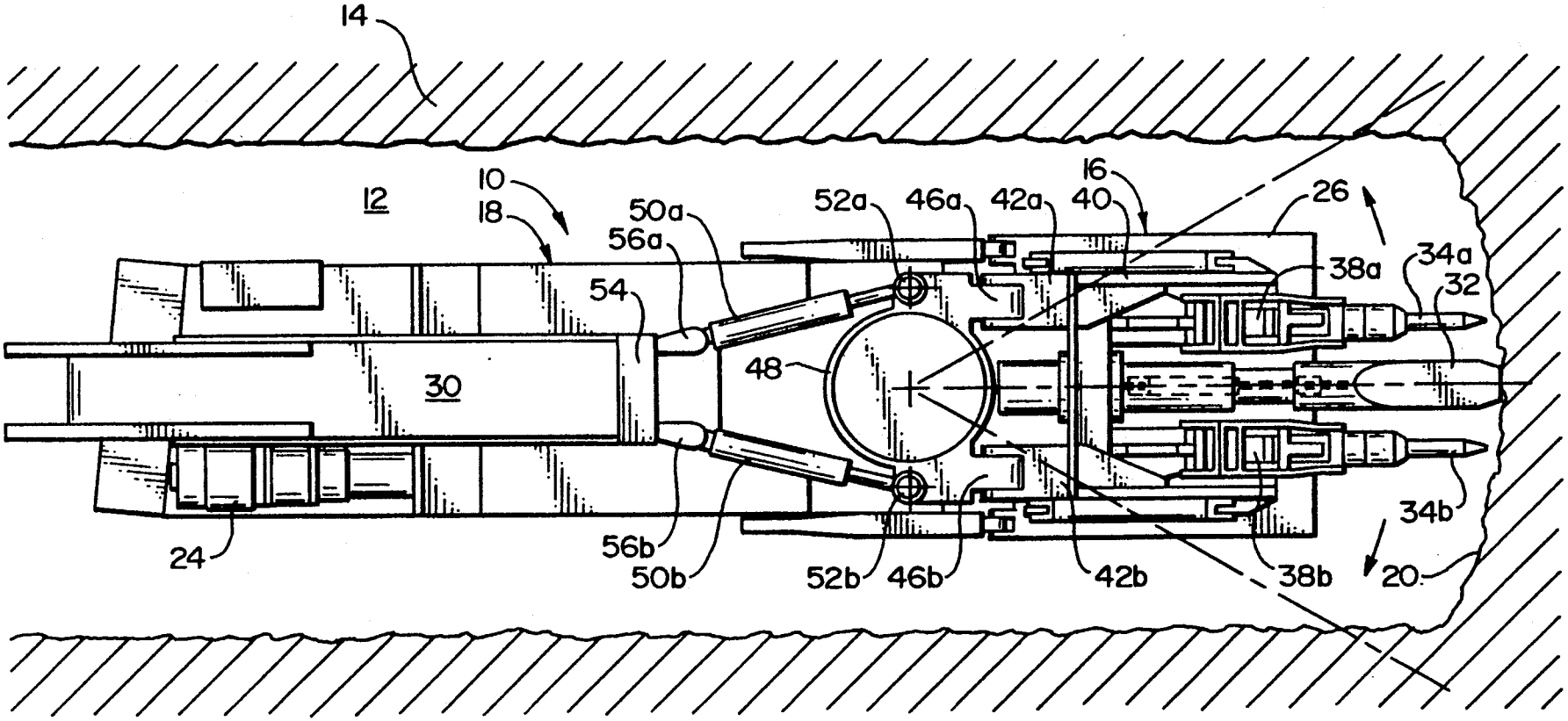
FIG. 2 is a plan view of the machine of FIG. 1, showing the manner in which the cutting head is also pivotable from side to side in the horizontal plane to excavate the tunnel.

FIG. 2 presents a plan view of machine 10, showing the cutter assembly and how this is mounted to the carrier 18 in somewhat greater detail. As can be seen, the forward end of the cutter assembly is provided with a central static ripper pick 32, and this is flanked by a pair of hydraulic impact hammers 34*a*, 34*b*. The cutter assembly is made up of a number of generally parallel right-hand and left-hand components and subassemblies, and so it will be understood that reference numerals followed by "a" refer to elements on the left-hand side of the machine, while "b" will denote the corresponding elements on the right-hand side of the machine.

As will be described in greater detail below, the ripper pick 32 is mounted to a hydraulic cylinder so that this can be selectively moved between extended and retracted positions. The two impact hammers, in turn, incorporate hydraulic pistons 38*a*, 38*b* which reciprocate their points forwardly and rearwardly at a relatively high rate (e.g., 30–40 cycles or more per second). These units may be conventional demolition hammers, such as the Model 730 Hy-Ram® hydraulic impact hammers which are available from Allied Steel and Tractor Products, Inc., 5800 Harper Road, Salem, Ohio, USA. Of course, other varieties of impact hammers may be substituted for the hydraulic piston units shown, including pneumatic hammers or hydraulically or electrically operated rotary eccentric hammers, for example.

The pick and hammers, together with their hydraulic cylinders, are mounted together in a pivotable frame 40. The rearward end of this forms a swinging fork arrangement having first and second legs 42*a*, 42*b*. These are mounted by pivot pins 44*a*, 44*b* (see FIG. 1) to forwardly extending lugs 46*a*, 46*b* of turntable 48 so as to permit vertical pivoting movement. The turntable itself is mounted to the underlying carrier for rotation in the horizontal plane. This rotation is accomplished by means of a pair of slew rams 50*a*, 50*b*; the forward ends of the rams are connected at pivot points 52*a*, 52*b* on opposite sides of turntable 48, and the rearward ends of the cylinders are mounted to a reaction member 54 on the chassis at pivot points 56*a*, 56*b*. Accordingly, when slew ram 50*a* is extended, this rotates the turntable and ripper pick/impact hammers in a clockwise direction; conversely, extension of slew ram 50*b* rotates these in the opposite direction.

Having provided an overview of the machine 10 in accordance with the present invention, a number of its structural features and their operation will now be described in greater detail with reference to FIGS. 3–6.

Articulated Carriage

Figure 3:
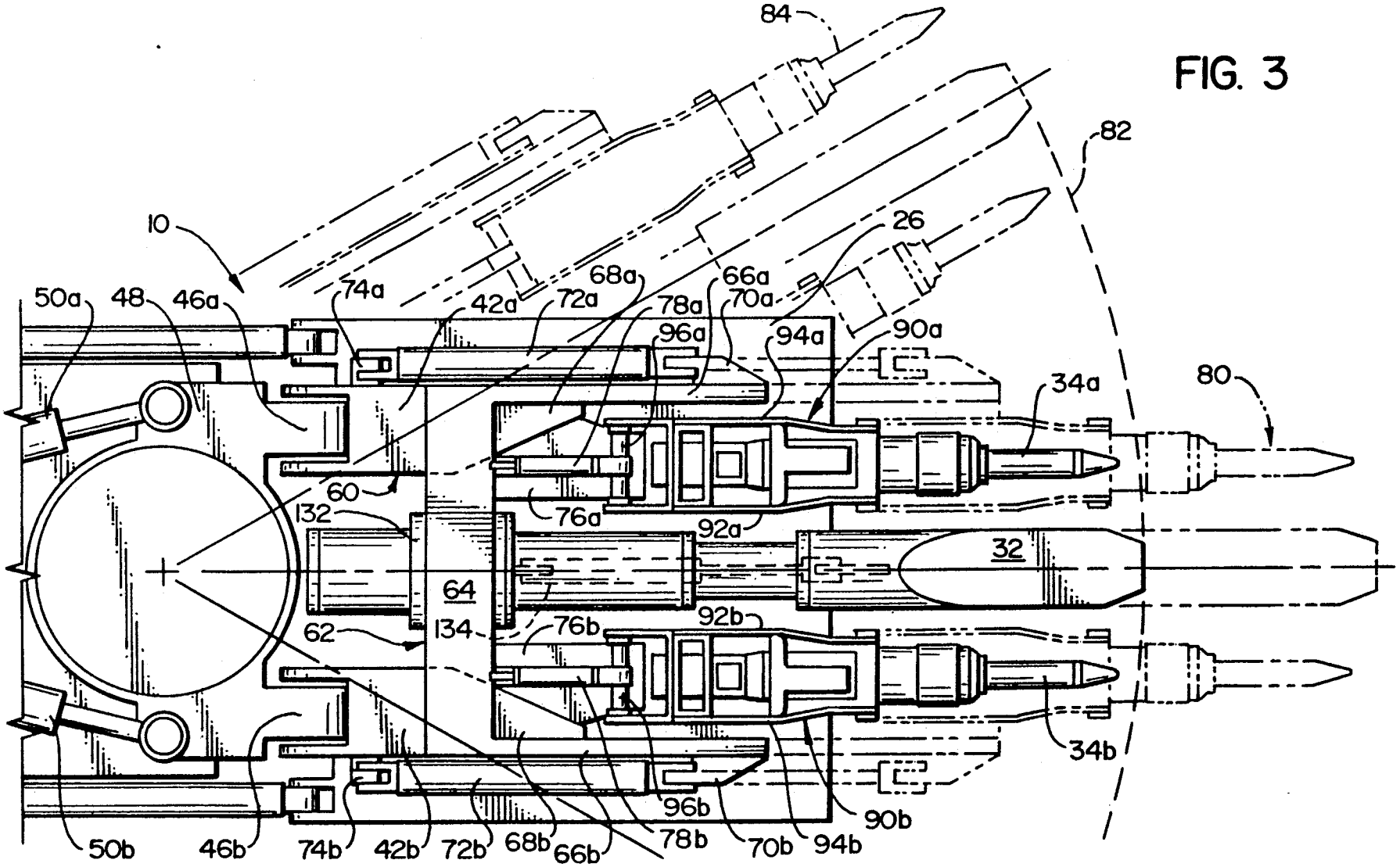
FIG. 3 is an enlarged view of the forward portion of the machine of FIG. 2, showing the manner in which the impact hammers and static pick of the assembly be extended and retracted.
Figure 4:
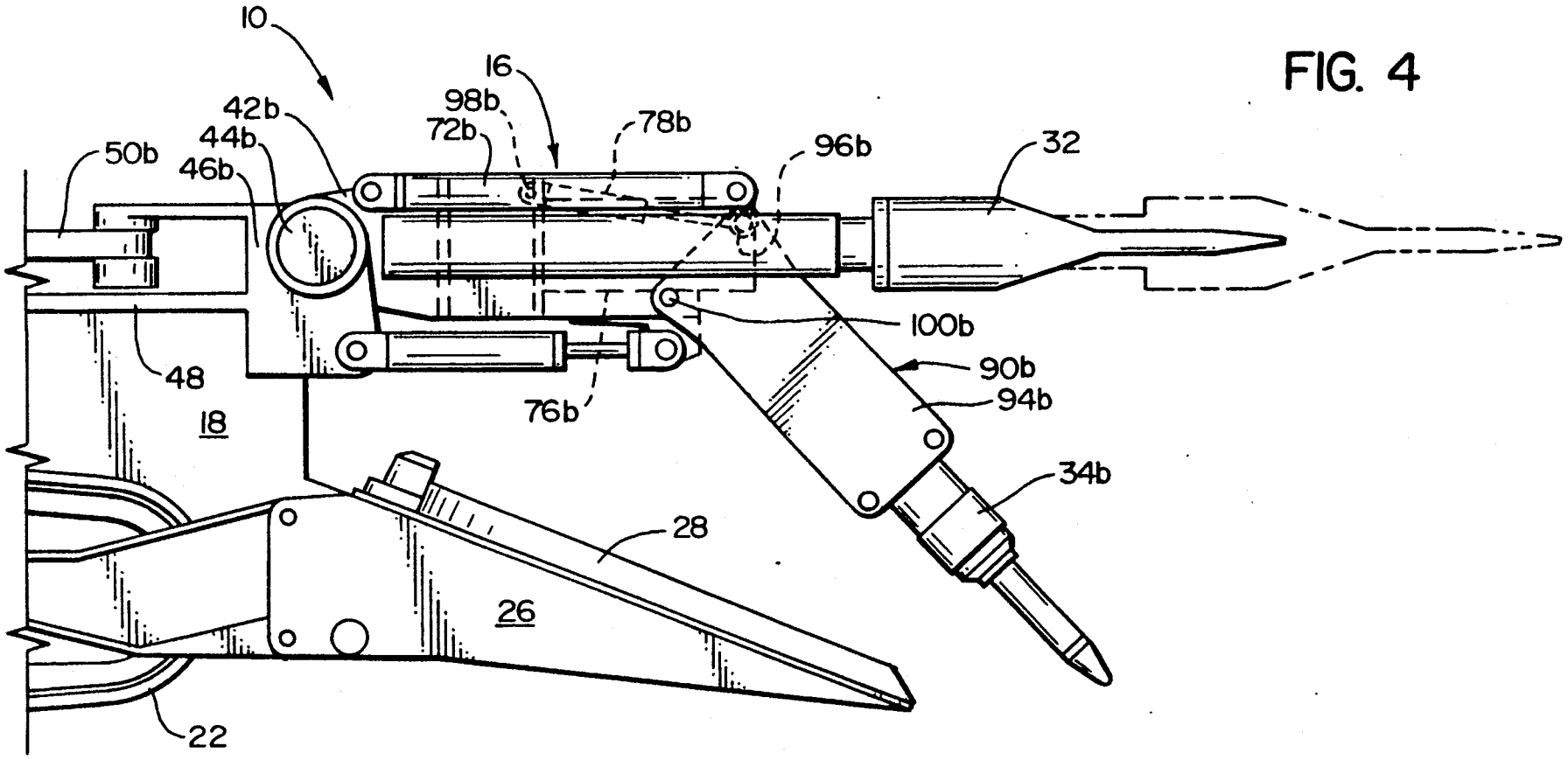
FIG. 4 is a side elevational view of the forward end of the machine of FIGS. 1–3, showing the manner in which the forward portion of the cutter assembly is articulated so that this is pivotable in a downward direction.

Turning to FIG. 3, this illustrates the manner in which the ripper pick and impact hammers are extendable in a generally axial direction. As can be seen, the pivotable frame 40 comprises two major subassemblies: there is a relatively fixed subframe 60 and a longitudinally sliding subframe 62. The forked legs 42*a*, 42*b* are part of the fixed subframe, these being pivotally mounted to the lugs 46*a*, 46*b* of turntable 48 in the manner previously described.

The sliding subframe 62, in turn, comprises a main crossbar member 64 at its rearward end, and parallel siderail members 66*a*, 66*b*, which extend forwardly from the ends of this. The crossbar member 64 is provided with slots (not shown), and guide plate portions 68*a*, 68*b* extend forwardly through this from the fixed subframe so as to support subframe 62 for sliding movement. The forward ends of hydraulic extension rams 72*a*, 72*b* are mounted to brackets 70*a*, 70*b* at the forward ends of the siderail members 66*a*, 66*b*, and the rearward ends of the rams are mounted to brackets 74*a*, 74*b* which extend from the sides of the rearward fixed subframe 60. Accordingly, when rams 72*a*, 72*b* are extended, subframe 62 slides forwardly from fixed subframe 60, riding along guide plates 68*a*, 68*b* as it does so.

The rearward end of the static ripper pick 32 is mounted to the central portion of crossbar member 64; the rearward ends of the two impact hammers 34*a*, 34*b* are also mounted to this member, by lower bracket plates 76*a*, 76*b* and upper tilting rams 78*a*, 78*b*. Consequently, when subframe 62 is extended forwardly, the pick and hammers move together with this. By this arrangement, the operator is able to selectively advance the working ends of the ripper pick and impact hammers from a retracted position to an extended position, as indicated by broken line image 80 in FIG. 3. This permits the ends of the cutter assembly to be advanced as the working face of the tunnel is cut away, without having to move the machine 10 itself; this avoids the difficulty of having to drive the carrier assembly constantly forward, and also reduces the frequency at which the conveyor belt or other transport system must be repositioned to receive the discharge from the machine.

As was noted above, frame 40 is also articulated to permit angulation of the impact hammers from an intermediate joint. Accordingly, turning to FIG. 4, this shows the right-hand impact hammer 34*b* having been rotated in a downward arc from the main plane of the cutter assembly. The impact hammer is mounted in a support cage 90*b* (see also cage 90*a* in FIG. 3), the primary structural members of this being inner and outer side plates 92*b* and 94*b*. The upper rear corners of the side plates are spanned by a transverse spindle 96*b*, and this provides a pivoting mount for the forward end of tilting ram 78*b*, the rearward end of this ram being mounted to crossbar member 64 at pivot 98*b*. The lower rear corners of the side plates, in turn, are rotatably mounted at pivot pin 100*b* to lower bracket member 76*b* which extends from the main crossbar of the sliding subframe. Therefore, when tilting ram 78*b* is extended, this drives the upper corner of the cage outwardly and downwardly around the fixed lower corner, so as to rotate the point of the impact hammer through a downward arc. Thus, the point of the impact hammer can be positioned somewhat below that of the static pick 32, so that this either leads or trails the pick depending on the direction of motion of the cutter assembly. This provides the operator with a variety of cutter configurations to choose from in order to deal with varying soil conditions. Of course, in some embodiments it may be preferable to configure the tilting rams so that when these are retracted, they pull the upper corners of the side plates back so as to elevate the impact hammers past the static pick. Furthermore, a second tilting ram could be substituted for the fixed length support brackets 76.

Figure 5:
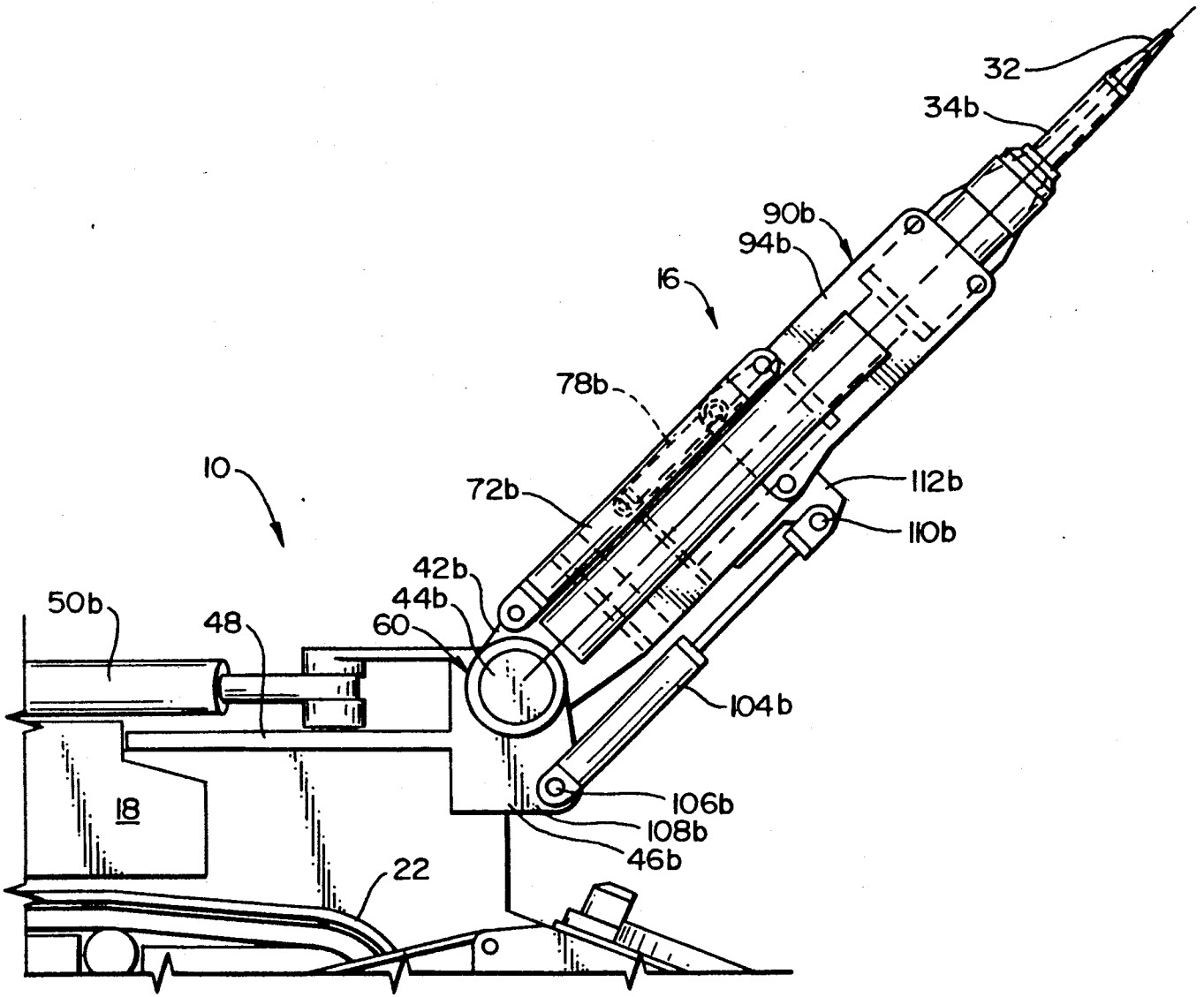
FIG. 5 is a side elevational view similar to FIG. 4, this showing the manner in which the cutter head assembly is pivotable through the vertical.
Figure 6:
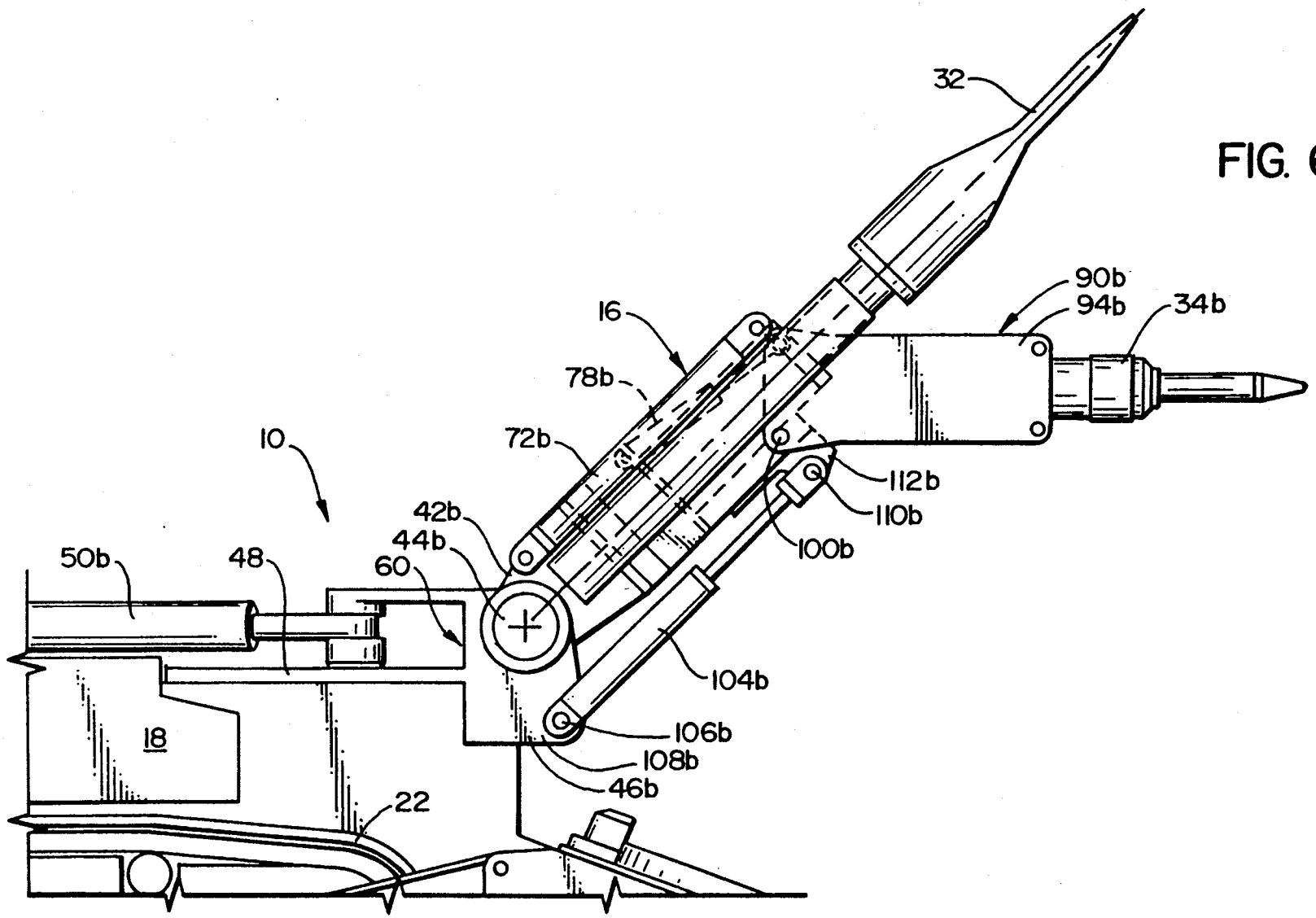
FIG. 6 is a view similar to that of FIG. 5, showing the main cutter assembly having been rotated to an upward orientation, and the tip portion of the assembly having been pivoted in a downwardly from this at the articulated joint.

FIG. 5 illustrates the elevation of the main cutter assembly 16 through the vertical arc. On the right underside of the cutter assembly there is an elevating ram 104*b* (a corresponding elevating ram 104*a* is similarly mounted on the left side of the assembly), this not being shown in FIG. 5. The rearward end of this is mounted by pivot pin 106*b* to a projecting bracket portion 108*b* of the stationary subframe, generally below and forward of the main horizontal pivot axis at pins 44*a*, 44*b*. The forward end of the ram, in turn, is mounted by a pivot pin 110*b* to a bracket 112*b* which extends downwardly from the siderail member 66*b* of the sliding subframe. Therefore, when the elevating rams 104*a* and 104*b* are selectively extended by the operator, the cutter assembly 16 rotates about the axis of pivot pins 44*a*, 44*b*, so that the forward ends of the ripper pick and impact hammers swing in an upward direction through the vertical arc. Conversely, by retracting the elevating rams 104*a*, 104*b*, the cutter assembly can be pivoted to a depressed position so as to reach the lower edge of the working face. An exemplary range through which the cutter assembly can be elevated is illustrated in FIG. 1.

Cutting Tools

Figure 7:
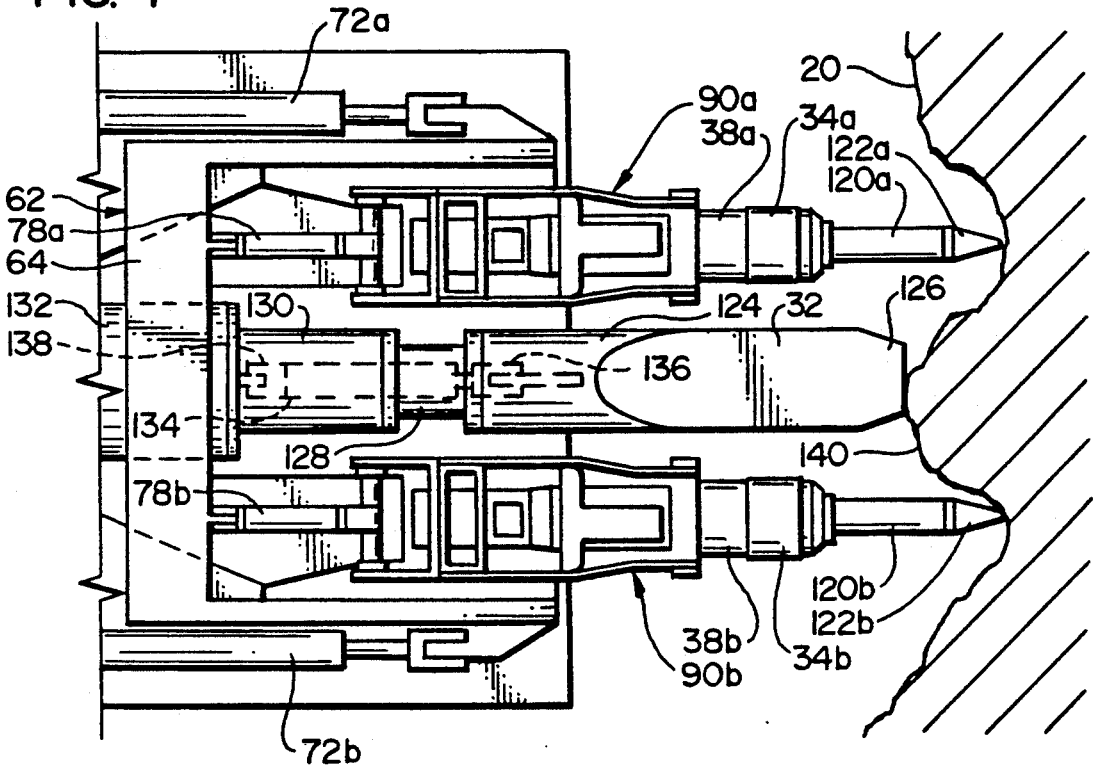
FIG. 7 is a plan view of the forward end of the cutter assembly, showing the static pick having been withdrawn to a rearward position at which it scarfs out the mound which is left between the impact hammers.
Figure 8:
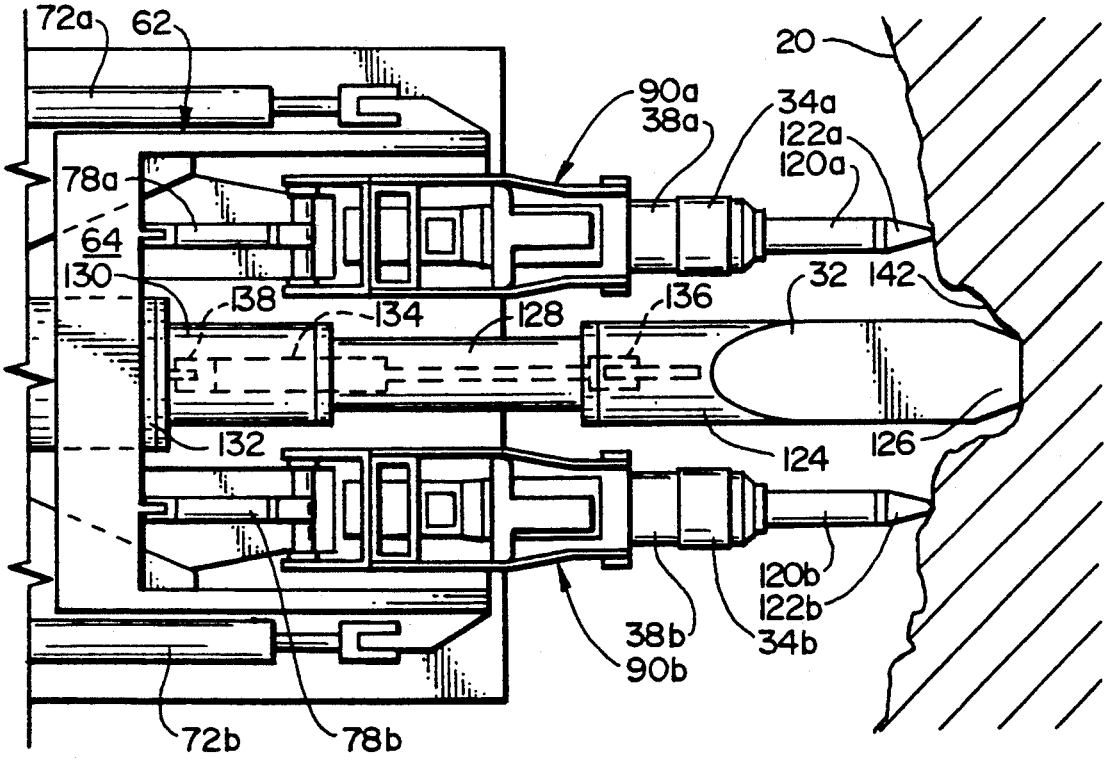
FIG. 8 is a view similar to FIG. 7, this showing the static pick having been extended in front of the impact hammers to scarf out a channel between the hammers.

FIGS. 7 and 8 illustrate exemplary modes of operation of the ripper pick and impact hammers. As was described above, each of the impact hammers comprises a reciprocating hydraulic piston assembly 38*a*, 38*b* which is mounted within a support cage 90*a*, 90*b*. A chisel rod 120*a*, 120*b* extends from the piston assembly, and the end of this is provided with a hardened point 122*a*, 122*b* for penetrating into and dislodging the material of the working face.

The impact hammers' tips are spaced apart laterally, and the static ripper pick 32 is positioned approximately midway between them. The distances by which the tips of these units are spaced apart may vary somewhat depending on the anticipated ground conditions; in the embodiment which is illustrated, an exemplary spacing between the tips of the impact hammers may be about 33 inches for use in permafrost tunnelling.

The ripper pick comprises a somewhat cylindrical shank member 124 which tapers to a hardened chisel tip 126. The shank of the ripper pick is mounted on the end of a large diameter rod 128 which is telescopingly received in a sleeve 130. This sleeve, in turn, is mounted by a shock-absorbing bushing 132 to the crossbar member 64 of the sliding subframe. A hydraulic cylinder 134 is enclosed with the hollow interior of the telescoping rod and sleeve, the forward end of this being mounted to the shank of the ripper pick at attachment point 136, and the rearward end being mounted to subframe 62 at attachment point 138. The head member of the pick can therefore be selectively extended and retracted by extending and retracting hydraulic cylinder 134.

FIG. 7 shows the ripper pick 32 in the retracted position. In this configuration, the points 122*a*, 122*b* of the impact hammers extend forwardly of the chisel tip 126 of the static pick. Thus, as the machine cuts away the working face, by sweeping the assembly through its vertical arc, the impact hammers carve out roughly parallel channels in the earth and leave a mound 140 of material between them. This mound, having been greatly weakened by the removal of the adjacent material, is relatively easily scarfed out by the chisel tip of the ripper pick. By angling the impact hammers using the tilting rams 78*a*, 78*b*, the tip of the pick can be positioned to either trail or precede the path of the impact hammers. Large volumes of material may therefore be removed from the working face at a relatively high rate using this technique. Another advantage which is made possible by the configuration shown in FIG. 7 is that this may be used to "straddle" a large boulder, whether this is still lodged in the formation or has become dislodged and fallen onto the tunnel floor: the points of the impact hammers can be positioned astride the boulder, and the static pick can be used to steady them in position, so that the boulder is rapidly shattered by concentrating the blows of the two hammers. In the case of relatively small boulders, these can be straddled between the ripper pick and one or the other of the hammers.

For some operations or ground conditions, however, it may be desirable to move the pick to the extended position shown in FIG. 8. As was noted above, this is accomplished by extending hydraulic cylinder 134 so as to telescope rod 128 outwardly from sleeve 130. As can be seen, the ripper pick may thus be used to gouge a channel 142 into the earth at the working face 20, and then the tips of the impact hammers striking the areas adjacent this can drive these inwardly toward the open groove so as to break these areas away. Under the right conditions, this can also provide an effective technique for removing material at a very rapid rate.

Another advantage of this aspect of the invention is that the operator can selectively advance the ripper pick so as to relieve the load on the impact hammers. It may sometimes happen that the forward force of the machine on the impact hammers is too great, so that these stall and their energy is converted into excess heat within the system. If this begins to happen with the machine of the present invention, the operator can simply extend the ripper pick until its tip engages the working face and "pushes off" from this to relieve the pressure on the cutter assembly, so that the impact hammers can begin to reciprocate again. Alternatively, or in combination with this, the operator can reduce the overall beam pressure so as to relieve the pressure on the impact hammers, by retracting or reducing the pressure in the extension rams 72*a*, 72*b*. Also, it may be desirable to configure the assembly for automatic reaction to relieve pressure on the impact hammers when necessary: for example, the hydraulic system may be equipped with pressure sensors for generating a signal when the hammers are subjected to excessive tip pressure, with control means being provided for automatically extending the static pick or reducing beam pressure in response to this signal. Such a system may desirably be configured to adjust the tip pressure on a continuous basis while the operator simply advances the machine toward the working face.

II. SIDEWALL MINING EMBODIMENT

Figure 9:
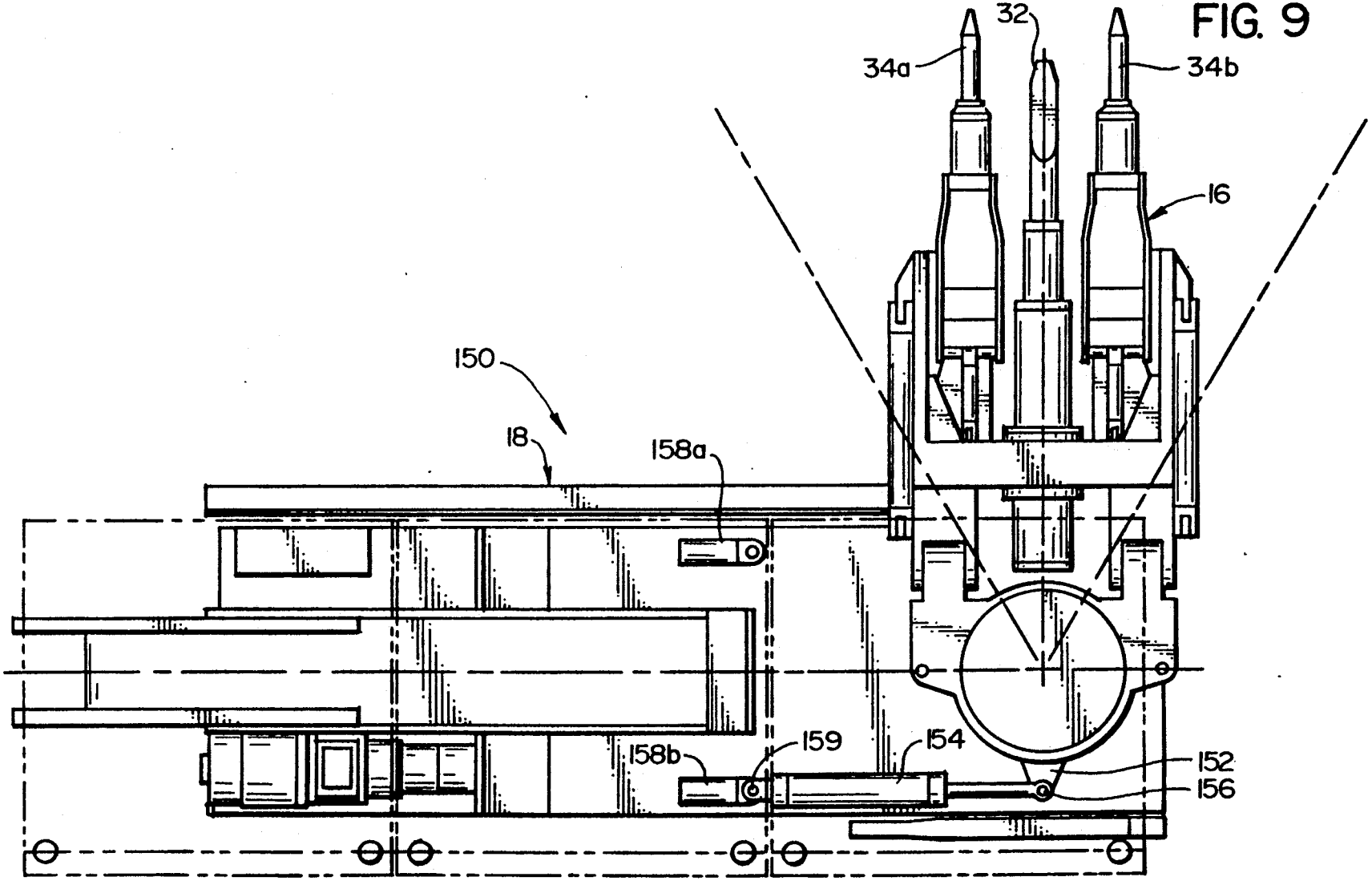
FIG. 9 is a plan view of an embodiment of the present invention in which the cutter assembly extends laterally from the chassis for excavation using a long-wall mining technique.
Figure 10:
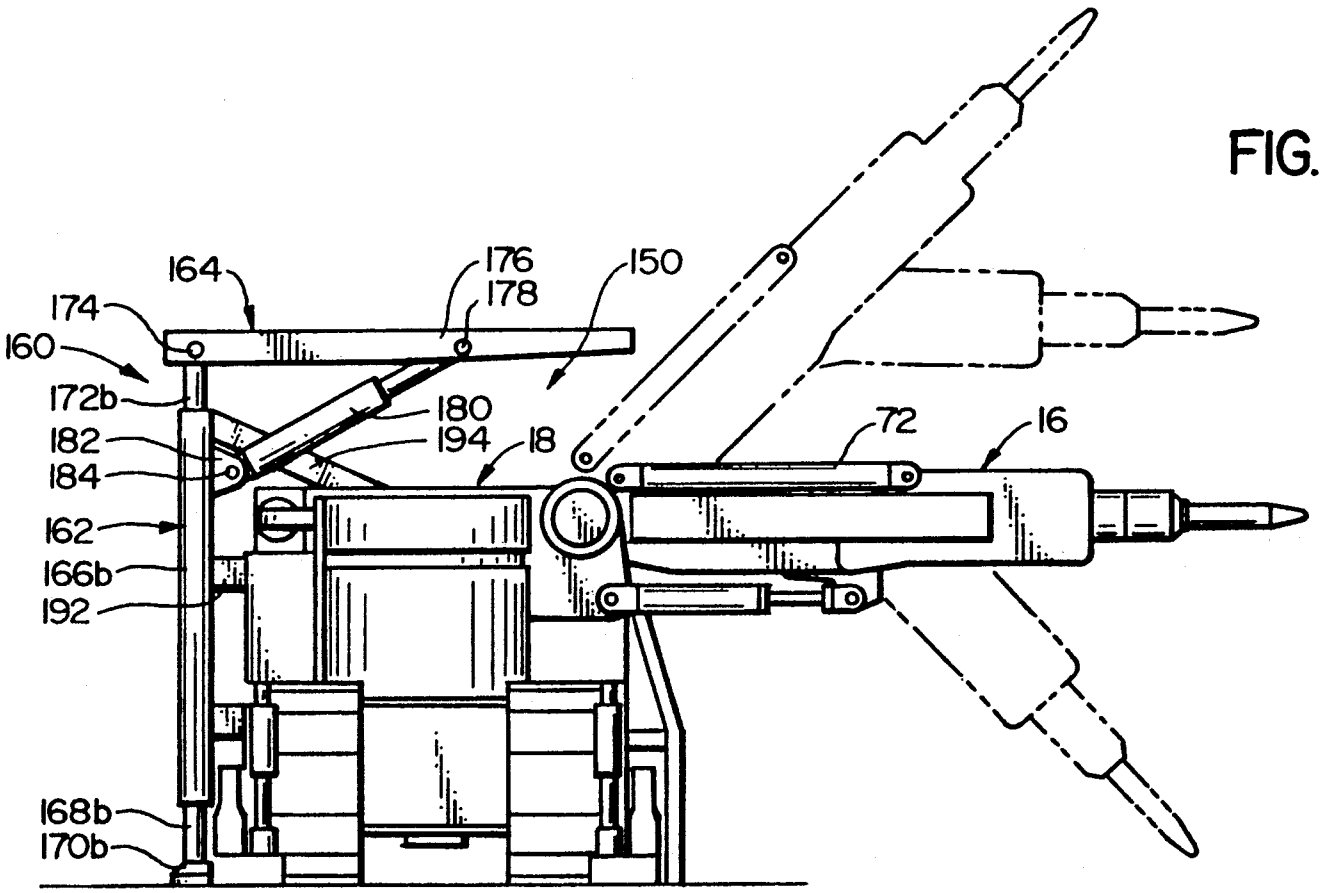
FIG. 10 is an end view of the machine of FIG. 9, showing the manner in which the cutter assembly is pivotable to various positions.

FIGS. 9–10 illustrate an embodiment of the present invention which has been configured for use in long wall mining or excavation. The cutter assembly 16 and carrier assembly 18 are essentially identical to those described above, and so will not be described again in detail. The principal change is that the arrangement of the turntable and slew rams has been modified so that the static pick and impact hammers extend to the side of the machine 150, generally perpendicular to its longitudinal axis. This is done by providing the turntable 48 with a single rearwardly projecting attachment member 152 at a position 180° opposite the pick and hammers. The forward end of a single slew ram 154 is attached to this at pivot pin 156, and the rearward end of the ram is connected to a mounting bracket 158*b* on the chassis at pivot pin 159, so that the slew ram extends generally parallel to the lengthwise axis of the chassis. A second mounting bracket 158*a* is provided on the opposite side of the carrier assembly for attachment of the slew ram 154 when the cutter assembly is reversed to project from the other side of the machine. Accordingly, as the slew ram 154 is extended and retracted, the working end of the cutter assembly swings back and forth through the horizontal arc shown in FIG. 9.

FIG. 10 is an end view of the machine 150, showing the movement of the cutter assembly in the vertical plane. Also, being that in this embodiment the cutter assembly excavates materials alongside the machine, rather than in front of it, the gathering apron 26 may be dispensed with, and may be replaced by a separate gathering assembly and conveyor belt (not shown).

FIG. 10 also shows a framework 160 which serves to protect the top and non-working side of machine 150 against collapse of the tunnel while the machine is engaged in long-wall mining. As is perhaps more clearly shown in FIG. 11, this protective framework comprises a series of modules arranged in a row to provide sufficient length to cover the machine. In the embodiment which is illustrated, there are three such modules, and each of these comprises generally a vertical support portion 162 and a pivoting upper frame portion 164 (see also FIG. 10). Each vertical support portion 162 is made up of a pair of vertical jacking cylinders 166*a*, 166*b*. Pedestal rods 168*a*, 168*b* extend from the lower ends of these, and are provided with frustoconical feet 170*a*, 170*b* which engage the floor of the excavation. Accordingly, when jacking cylinders 166 are extended, these raise the tops of the cylinders upwardly in the mine.

Stanchion rods 172*a*, 172*b* extend from the tops of the jacking cylinders, and an upper frame portion is mounted to the upper ends of these at pivot pins 174. A horizontal strongback 176 extends inwardly from the pivot, and an end of a hydraulic ram 180 is mounted to a middle portion strongback 176 at pivot pin 178. The other end of this ram is mounted to a bracket 182 lower down on the jacking cylinder 166, by another pivot pin 184; accordingly, by extending hydraulic cylinder 180, the upper frame portion 164 can be erected, and the angle at which it extends from the vertical supports can be adjusted upwardly and downwardly as desired to support the ceiling of the excavation.

Figure 11:
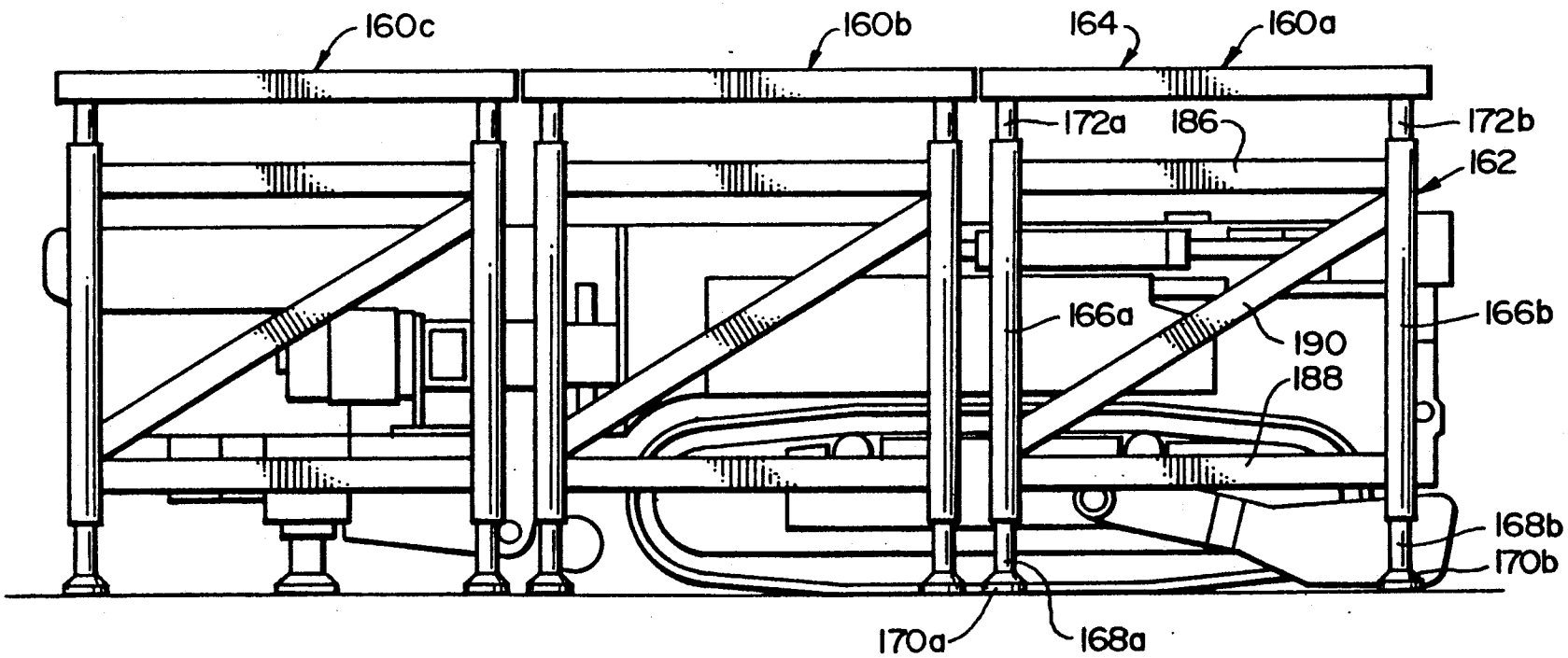
FIG. 11 is a side elevational view of the machine of FIGS. 9–10, showing how this is surrounded by a protective framework.

The framework assembly 160 is also provided with a number of bracing members to increase its rigidity. For example, framework 160*a* in FIG. 11 is provided with upper and lower horizontal cross members 186, 188, and a diagonal cross member 190, which extend between the two upright stanchions or cylinders. Furthermore, there may be horizontal and angled braces 192, 194 (see FIG. 10) extending from the upright stanchions or cylinders to support points (not shown) on the machine 150 so as to hold the framework upright, being that the machine remains stationary for extended periods while engaged in the long wall excavation.

It will therefore be understood that long wall mining with the machine 150 of the present invention my proceed as follows: the machine may be positioned at a first location with the protective framework erected about it to support the walls and ceiling of the excavation. The cutter head may then be operated through the vertical and horizontal arcs so as to remove material from a roughly hemispherical area, with the extension rams 72 being periodically extended to increase the depth of the excavation. Then, when the excavation which can be performed from the first location has been completed, the machine is moved forwardly to the next position, and the rearmost framework module 160*c* (see FIG. 11) is taken down and moved to the forward end of the machine. Excavation then continues from this location. In this manner, the machine can make a continuous long-wall excavation by moving sequentially along the face, and the formation may be permitted to collapse behind it as the excavation progresses. It will be understood that in this configuration the machine itself is not loading the dislodged material onto a conveyance system for transportation from the excavation; rather, it serves to speed up the material excavation, and does this on a continuous basis. This is to be contrasted with traditional long wall mining techniques, wherein the working face is normally drilled and blasted, and then the conveyance system is moved into place to remove the material.

It is to be understood that all matter herein set forth or shown in the accompanying drawings is to be interpreted as illustrative and not in a limiting sense. It will be understood that certain features and subcombinations are of utility and may be employed without reference to other features and subcombinations. This is contemplated by and is within the scope of the appended claims.

What is claimed is:

1. An excavating machine, comprising:

a chassis assembly;

a cutter assembly mounted to said chassis assembly, said cutter assembly comprising:

(a) at least one static pick having a tip portion, and (b) first and second impact hammers mounted generally on opposite sides of said static pick so that tip portions of said impact hammers generally flank said tip portion of said pick; and means for moving said tip portions of said reciprocating hammer and said static pick in combination across a working face so as to remove material therefrom.

2. The excavating machine of claim 1, further comprising:

means for selectively (a) extending said tip portion of said static pick forwardly of said tip portions of said impact hammers toward a said working face, and (b) retracting said tip portion of said pick rearwardly of said tip portions of said hammers away from a said working face.

3. The excavating machine of claim 1, wherein said means for moving said tip portions in combination across a working face comprises:

means for moving said tip portions of said impact hammers and said static pick together simultaneously along a path across a said working face.

4. The excavating machine of claim 3, further comprising:

means for selectively offsetting said tip portions of said impact hammers from said tip portion of said static pick so that said tip portion of said pick advances or trails said tip portions of said hammers as said tip portions move together along a said path across a said working face.

5. The excavating machine of claim 1, wherein said means for offsetting said tip portions comprises:

means for pivoting said impact hammers relative to a longitudinal axis of said static pick.

6. The excavating machine of claim 1, wherein said means for moving said tip portions in combination comprises:

a turntable mounted to said chassis assembly for rotation in a generally horizontal plane; and a carriage assembly pivotably mounted to said turntable for elevation in a generally vertical plane, said cutter assembly being mounted to said carriage assembly.

7. The excavating machine of claim 6, wherein said carriage assembly comprises:

a support portion to which said static pick is fixedly mounted; and an articulated portion to which said impact hammers are mounted, said articulated portion being selectively pivotable relative to said support portion so as to pivot said tip portions of said impact hammers within planes generally parallel to a longitudinal axis of said pick to a position in which said tip portions of said hammers are offset from said tip portion of said pick, so that said tip portion of said static pick advances or trails said tip portions of said impact hammers as said carriage assembly is elevated in a said vertical plane.

8. The excavating machine of claim 7, wherein said carriage assembly further comprises:

means for selectively (a) extending said tip portion of said static pick forwardly of said tip portions of said impact hammers, and (b) retracting said tip portion of said static pick rearwardly of said tip portions of said impact hammers.

9. The excavating machine of claim 8, wherein said means for selectively extending and retracting said tip portion of said pick comprises:

a telescoping portion of said static pick; and an extendable ram mounted to said pick for selectively extending and retracting said telescoping portion thereof.

10. The excavating machine of claim 8, wherein said carriage assembly further comprises:

means for selectively extending said tip portions of said impact hammers and said static pick together forwardly from said chassis assembly.

11. The excavating machine of claim 10, wherein said means for selectively extending said tip portions together forwardly from said chassis assembly comprises:

at least one extendible ram operatively interconnecting said carriage and said chassis assembly for selectively extending said support and articulated portions of said carriage forwardly from said chassis assembly.

* * * * *